US011939779B2

(12) United States Patent
Sanborn

(10) Patent No.: US 11,939,779 B2
(45) Date of Patent: Mar. 26, 2024

(54) WINDOW WELL SYSTEMS

(71) Applicant: Torrey Sanborn, Larkspur, CO (US)

(72) Inventor: Torrey Sanborn, Larkspur, CO (US)

( * ) Notice: Subject to any disclaimer, the term of this patent is extended or adjusted under 35 U.S.C. 154(b) by 27 days.

(21) Appl. No.: 17/546,164

(22) Filed: Dec. 9, 2021

(65) Prior Publication Data

US 2023/0183989 A1 Jun. 15, 2023

(51) Int. Cl.
*E04F 17/06* (2006.01)

(52) U.S. Cl.
CPC ..... *E04F 17/06* (2013.01)

(58) Field of Classification Search
CPC ..... E04F 17/00; E04F 17/06
USPC ..... 52/20, 107
See application file for complete search history.

(56) References Cited

U.S. PATENT DOCUMENTS 2,453,609 A 11/1948 Whitehouse
3,004,634 A 10/1961 Evans
5,387,380 A 2/1995 Cima et al.
6,880,300 B2 4/2005 Hawkes
7,141,207 B2 11/2006 Jandeska, Jr. et al.
7,549,256 B1 * 6/2009 Watkins ..... E06C 9/02 52/107
7,730,674 B1 6/2010 Gernstein
2005/0115169 A1 * 6/2005 George ..... E04F 17/06 52/107
2011/0203194 A1 * 8/2011 Kelsch ..... E04F 17/06 52/173.1
2011/0302853 A1 * 12/2011 Wiwi ..... E04F 17/06 52/107

* cited by examiner

*Primary Examiner* — William V Gilbert
(74) *Attorney, Agent, or Firm* — Edison Law Group

(57) ABSTRACT

A window well is disclosed. The window well has a curved wall that has an inner wall section, an upper wall section, and a base. The upper wall section is unitary with the inner wall section. The curved wall includes an outer wall section unitary with the upper wall section. Between the inner and outer wall sections is an air space. The curved wall further includes at two horizontally oriented members or footholds that are unitary with, and that extend inwardly toward the center of curvature of, the curved wall, and which are spaced above the base. Each foothold includes a spaced-apart pair of handholds dimensioned, configured, and oriented to enable a user to extend an adult palm through, to securely grasp the handholds.

13 Claims, 10 Drawing Sheets

WINDOW WELL SYSTEMS

FIELD

The present subject matter is generally directed to the field of window wells. The present subject matter, in particular, is for window well structures useable as below-grade egress systems, where such egress systems can be vertically stacked.

BACKGROUND

A basement (occasionally also referred to as a "cellar") may include one or more levels of a building, with levels being completely or partly below grade, where the term "grade" shall be used throughout this patent application to mean an average surface level outside a particular building. For certain residential buildings, a basement is used in connection with homes where space below a ground floor is habitable. Often, a basement will include at least one window to allow natural light to enter and will have at least one access. The word cellar may apply to an entire underground level or merely an underground room. A subcellar is a cellar that lies further below grade. While a basement can be used in substantially the same manner as an additional above-ground floor of a home or other building, the use of a basement depends largely upon a variety of factors including geographical areas, climate, soil, seismic activity, building technology, and real estate economics.

The present subject matter for structural systems associated with windows provided below grade are well known. See, e.g., U.S. Pat. No. 1,840,397 to Keyes and U.S. Pat. No. 2,162,628 to Martin. Such systems, formerly characterized as being for "areaway construction," are presently characterized as relating to "window wells."

As many of ordinary skill in this field can appreciate, improvements resulted in U.S. Pat. No. 4,704,828 to Kemp; U.S. Pat. No. 6,484,455 to Poole; U.S. Pat. No. 6,880,300 to Hawkes; U.S. Pat. No. 6,915,612 to Oakley; U.S. Pat. Nos. 7,171,786; 7,717,879; 7,730,673; and 7,958,692, all to George; U.S. Pat. No. 7,444,784 to Brown; U.S. Pat. No. 7,549,256 to Watkins; and U.S. Pat. Nos. 7,730,674 and 7,861,468, both to Gernstein.

Further improvement resulted in the grant of U.S. Pat. No. 7,966,776 to Cook; U.S. Pat. No. 8,250,815 to Siepel; U.S. Pat. No. 8,578,662 to Monk; U.S. Pat. No. 8,690,359 to Clock; U.S. Pat. No. 9,816,315 to Price et al.; and U.S. Pat. No. 10,662,708 to Snarr.

For instance, the '708 patent to Snarr is for a window well egress system allowing a small child to use a ladder to escape from a window well. The '315 patent to Price et al. is directed to a window well cover with a screened frame that prevents debris from falling into a window well yet allows natural light to enter a cellar environment. The '359 patent to Clock discloses a system for a basement window that includes a periscope-type mechanism for enabling internal occupants a view of the surrounding outdoor landscape. The '662 patent to Monk discloses a window wall enclosure with attachable steps. The '815 patent to Siepel is for a window well cover. The '776 patent to Cook is directed to a textured window well.

The '468 and '674 patents, both to Gernstein, are for window well structures enabling a person to escape from a basement environment through a basement window. The '256 patent to Watkins is directed to window well modules. The '784 patent to Brown discloses a system for securing a cover or grid over a window well.

The '692; '673; '879; and '786 patents, all to George, disclose an assortment of window well structural details. The '612 patent to Oakley is directed to window wells that are said to have in-ground stability. The '300 patent to Hawkes is directed to window wells, which include integrally formed steps, that can be manufactured from various composite materials. The '455 patent to Poole is directed to a rigid window well. The '828 patent to Kemp is directed to snap-together window wells.

Thus, when reviewed individually or in combination, the above patents do not solve problems—found in many current window wells—which are solved by the present subject matter. For example, not only are window wells of the present subject matter—my present invention—made of relatively light-weight, durable materials of one-piece construction, characterized as a curved sidewall having a smooth exterior surface that substantially reduces, or eliminates, the vertical load problems known to be present in prior art window wells, the relatively light-weight yet durable window wells of the present subject matter are stackable, and include a ladder that is unitary-in-construction with an inner surface of the curved sidewall.

In addition, the window wells of the present subject matter have a bottom region that is completely open, allowing the soil as well as any aggregate that may be present to uplift relatively freely whenever soil-uplifting conditions are present.

The window wells of the present subject matter include many additional features and advantages, some of which are introduced in the following summary. For example, horizontally oriented members that I call footholds, are integral structural components providing the window well with desired structural rigidity. Additional structural advantages will be clear after reading the detailed description.

SUMMARY

A window well of the present subject matter is characterized as having a vertically oriented curved wall including an inner wall section and an upper wall section. The upper wall section is unitary with the inner wall section. The curved wall includes an outer wall section that is also unitary with the upper wall section. Between the inner wall and the outer wall sections is an air gap space. The curved wall includes a base that is unitary with one of the inner and the outer wall sections.

The upper wall section includes a first upper surface portion that is unitary with the inner wall section. The upper wall section further includes a second upper surface portion that is unitary both with the first upper surface portion and with the outer wall section. One of the first and second upper surface portions is spaced further from the base than the other. The base includes an underside surface that is configured to engage with the first and the second upper surface portions of the upper wall section. The curved wall further includes at least one horizontally oriented member that is unitary with and that extends from the inner wall section of the curved wall and that is spaced from the base. The at least one horizontally oriented member includes an elongated aperture or opening that is dimensioned, configured, and oriented for enabling a user to extend a user's palm therethrough.

BRIEF DESCRIPTION OF THE DRAWINGS

Throughout the drawing figures and detailed description, I shall use similar reference numerals to refer to similar components of the present subject matter.

DETAILED DESCRIPTION

Figure 1:
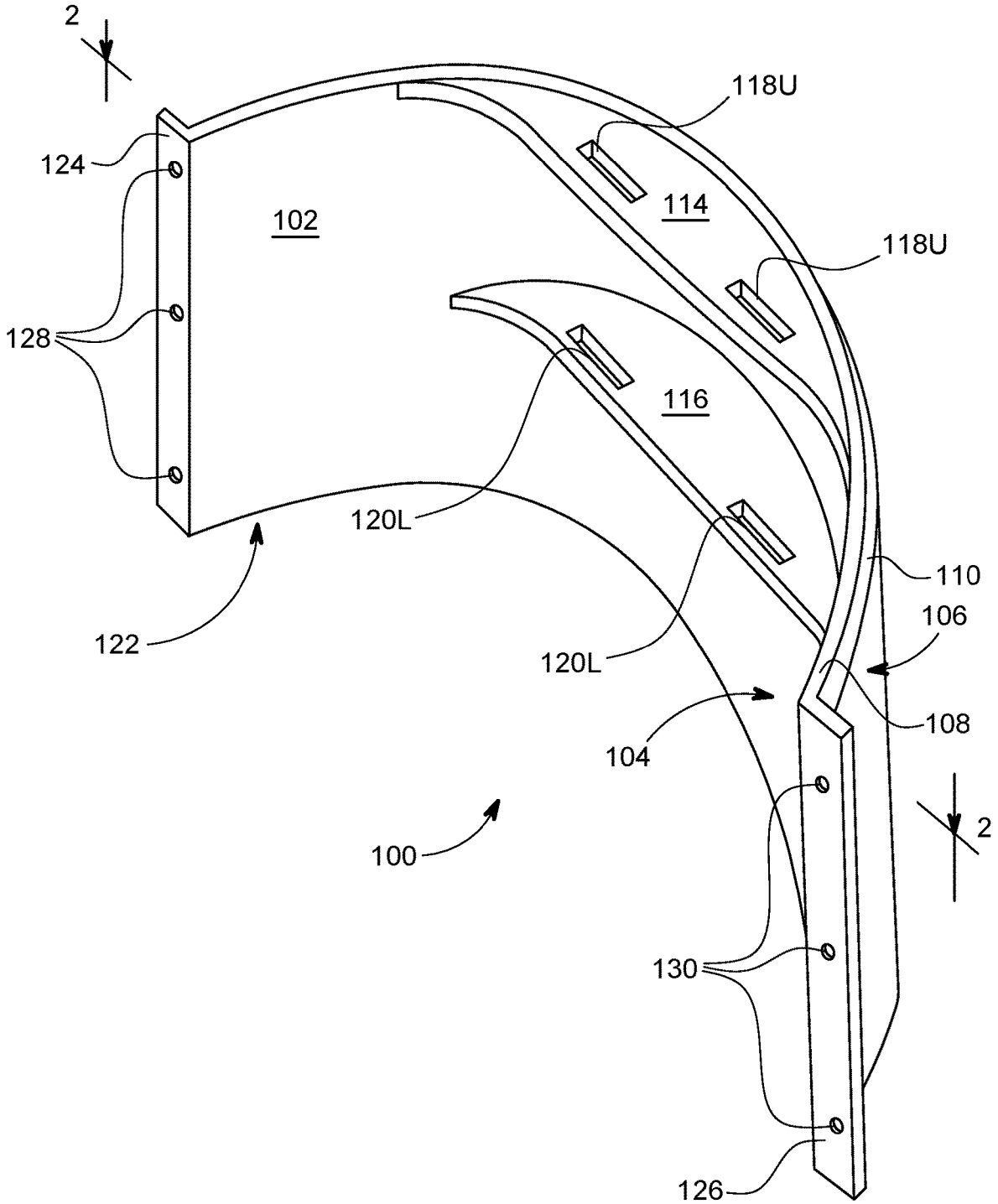
FIG. 1 is a hand-drawn sketch presenting, in perspective, an embodiment of a one-piece window well unit or module according to the present subject matter.
Figure 3:
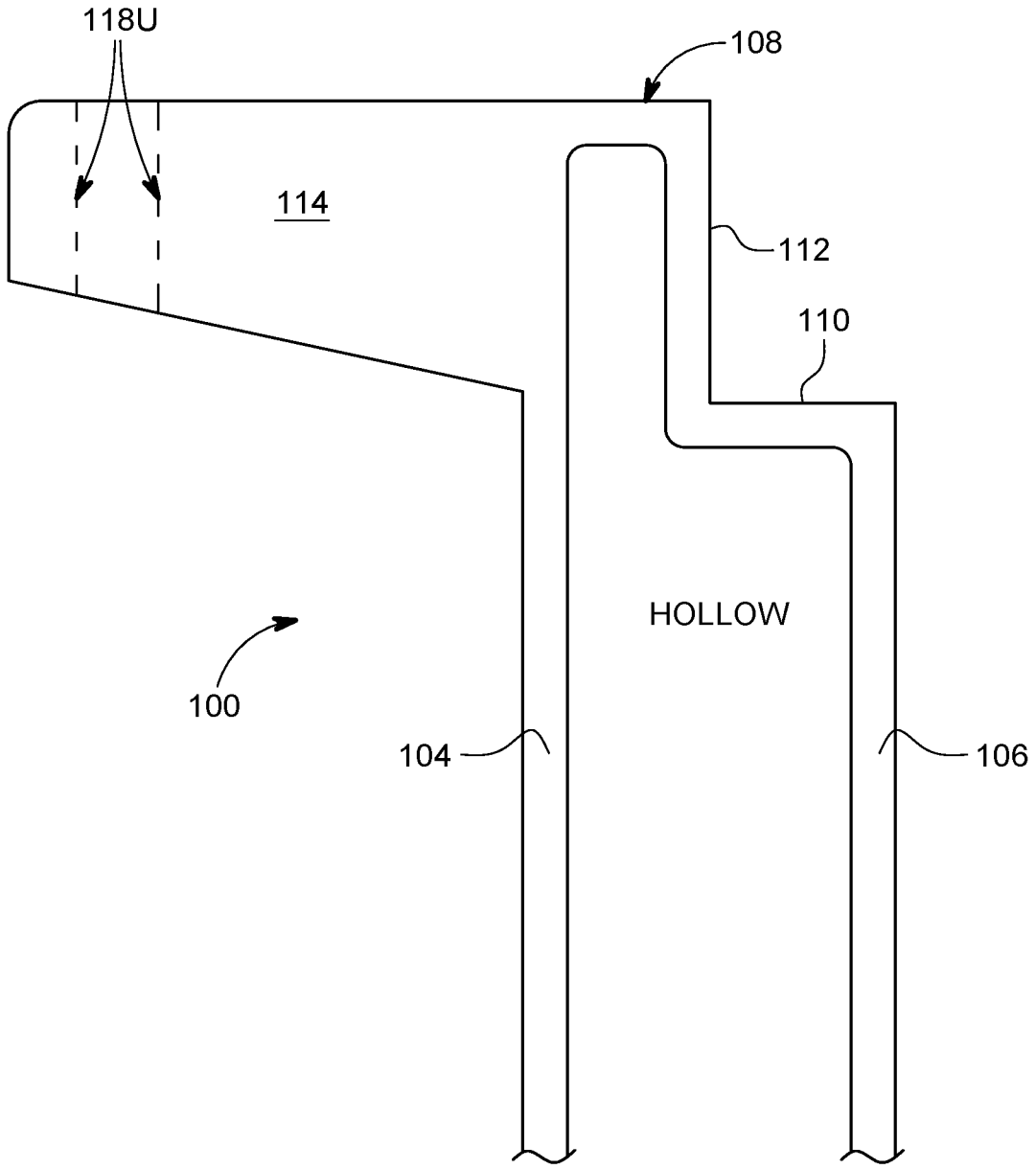
FIG. 3 is a sectional view of an embodiment from the plane 3-3 in FIG. 2.

To begin the detailed description of the present subject matter, please refer initially to FIG. 1, my hand-drawn sketch, depicting a unitary window well 100. The window well 100 includes an arcuate (or gently curved) generally vertically oriented wall 102 having an inner wall section 104 and an outer wall section 106. The window well further includes an upper wall section 108 unitary with the inner wall section 104. The outer wall section 106 includes a ledge 110 that is unitary with the outer wall section. 106. Next, please refer briefly to FIG. 3 to see that the window well of the present subject matter includes a vertically oriented exterior sidewall portion 112 that is unitary with the ledge 110 and upper wall section 108.

Referring back to FIG. 1, the unitary window well 100 of the illustrated embodiment of the present subject matter further includes an upper horizontally oriented lateral member 114 unitary with the upper wall section 108 (FIG. 3), and at least one additional horizontally oriented lateral member 116, spaced below and substantially parallel to the upper lateral member 114. Where there are more than one, all such lower lateral members 116 are integral with the curved wall 102. The illustrated embodiment, however, includes only one such lower lateral member 116.

Figure 2:
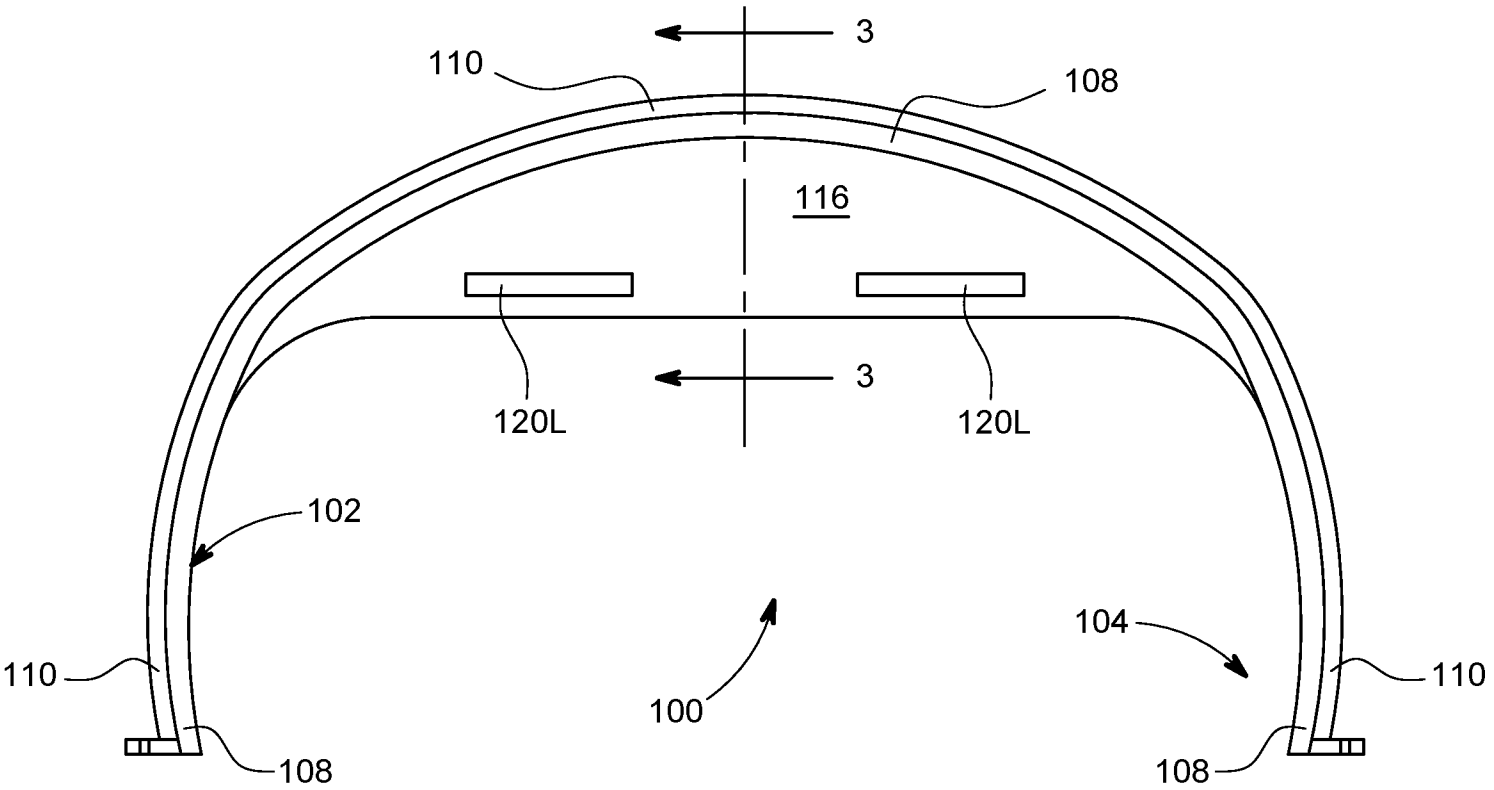
FIG. 2, also a hand-drawn sketch, is a plan view from the plane 2-2 in FIG. 1.

For the present subject matter, the horizontally oriented lateral members 114 and 116—which some of ordinary skill in this field may refer to as "steps"— were, in fact, especially designed to extend away from the exterior surface of inner wall 104 a sufficient distance for presenting a secure foothold to a person stepping onto either the lower or upper horizontally oriented lateral member 114 or 116. The upper and lower horizontally oriented lateral member each includes at least two spaced apart, elongated openings or apertures 118U and 120L, associated with the upper and lower horizontally oriented lateral member respectively, with each one of the elongated openings or apertures 118U and 120L being dimensioned and configured for enabling an adult person to extend a palm sufficiently through to enable the fingers to securely grasp lateral member 114, 116 to proceed upwardly. My design can perhaps be better understood when viewing FIGS. 1 and 2 together.

Figure 4:
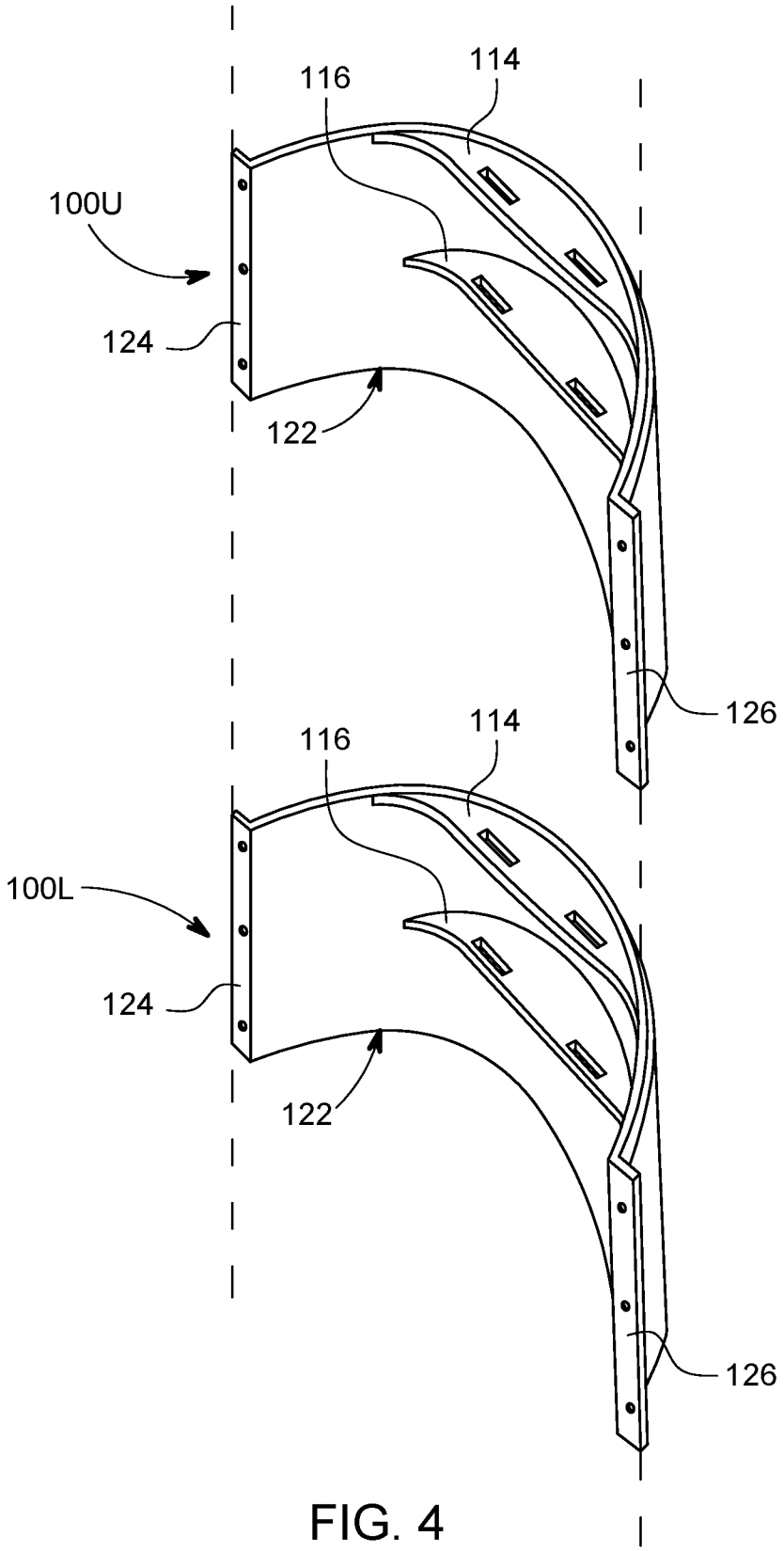
FIG. 4, also a hand-drawn sketch presents, in perspective, an embodiment of a system comprising window well modules, pursuant to the present subject matter.

For the present subject matter, the unitary window well 100 (FIG. 1) was especially designed as a unit or module of a system that includes at least one other unitary window well serving as a first or lower unitary window well 100L, upon which is mounted a second or upper unitary window well 100U, as shown in FIG. 4.

Figure 8:
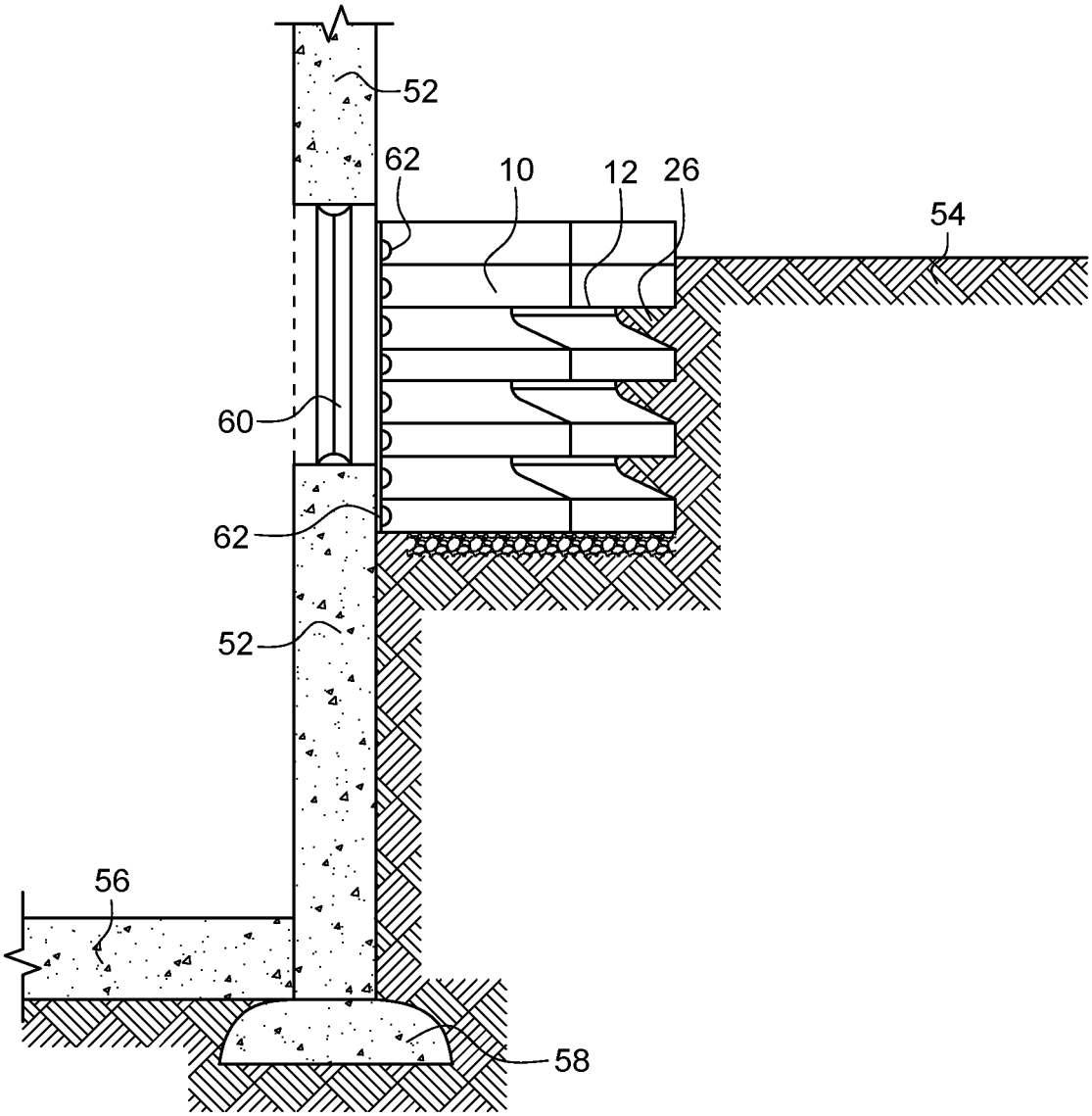
FIG. 8 presents a prior art window well, as used in its typical environment.

Let us now briefly refer to FIG. 8, borrowed from the '455 patent to Poole (which is directed to rigid window well), for background regarding the environment of the present subject matter. Referring now to FIG. 8, a prior art structure 10 which includes steps 12 is shown attached to a typical concrete foundation wall 52. The foundation wall 52 and prior art window well structure 10 act to retain earth 54 on the exterior of the foundation wall 52. On the interior of the foundation wall 52, a concrete slab 56 which serves as an interior floor is shown. The foundation wall 52 is supported by a footing 58. Within a space defined by the foundation wall 52 is a window 60 protected from the earth 54 by the window well structure 10. The window well structure 10 is fastened to the foundation wall 52 by fasteners 62. Step cavities 26 are in contact with, and back filled with, earth 54, such that the surrounding earth packs the cavities 26, adding additional strength to the steps 12.

Let us now imagine that the window 60 extends vertically downwardly, perhaps 7 or 8 feet, from where it is affixed to the foundation wall 52. Imagine also that a window well escape system consisting of an upper unitary window well unit or module 100U and a plurality (meaning two or more) lower unitary window well units or modules 100L, of the present subject matter, vertically stacked or arranged within an excavated space or region within the soil or earth 54 adjacent the window 60 now extends downwardly (as imagined above). Imagine further that the thus extended window 60 pivots about an axis (not shown) located along an upper region of the window 60, to enable a lower region of the window 60 near the floor or concrete slab 56 to swing away from the foundation wall 52, for enabling a person to escape through the window using the vertically stacked arrangement of upper and lower window well modules 100U, 100L of the present subject matter which provide a person with a ladder having a sufficient number of footholds 114 and 116 (please see FIG. 4) and handholds 118U and 120L (please refer to FIG. 1).

Returning briefly to FIG. 1, each unitary window well unit or module 100 of the present subject matter includes a base 122 unitary with one of, or both of, the inner wall 104 and the outer wall 106 sections of arcuate or curved wall 102. In addition, each unitary window well unit or module 100 of the present invention includes a pair of integral flanges 124 and 126 which are located at opposite ends of curved wall 102. The one flange 124 and the other flange 126 are each oriented transverse to curved wall 102, and each include an effective number of apertures or through bores 128 and 130 for using conventional fasteners or fastener systems to secure a single window well 100 or a plurality of window wells 100 to structural elements of a basement window, as shown in U.S. Pat. No. 3,004,634 to Evans et al. or to an exterior wall as shown in U.S. Pat. No. 2,453,609 to Whitehouse. Those of ordinary skill in this field are aware of other fastener systems which could be used.

Figure 5:
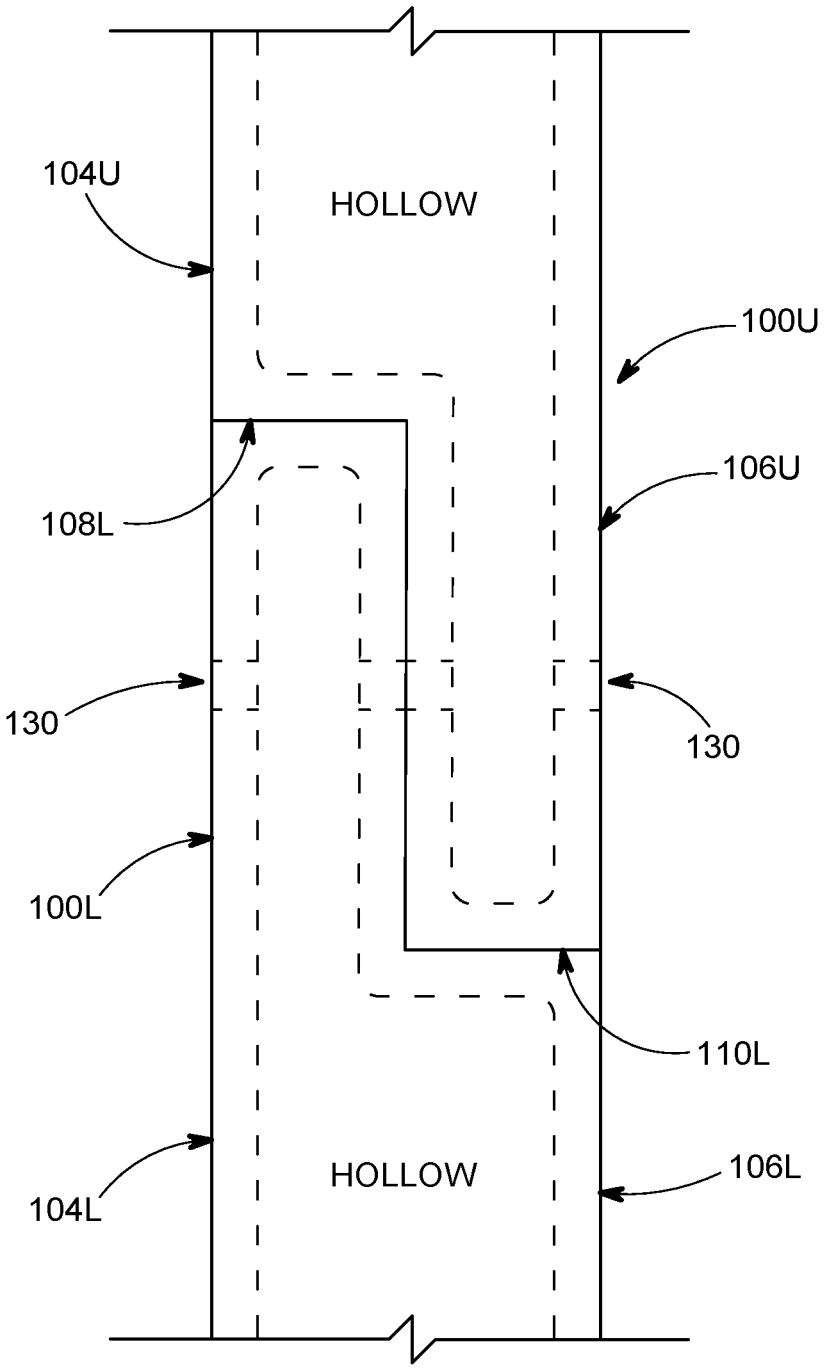
FIG. 5, also a hand-drawn sketch presents, on an enlarged scale, a partially fragmented structural detail from the window well modules presented in FIG. 4.
Figure 5A:
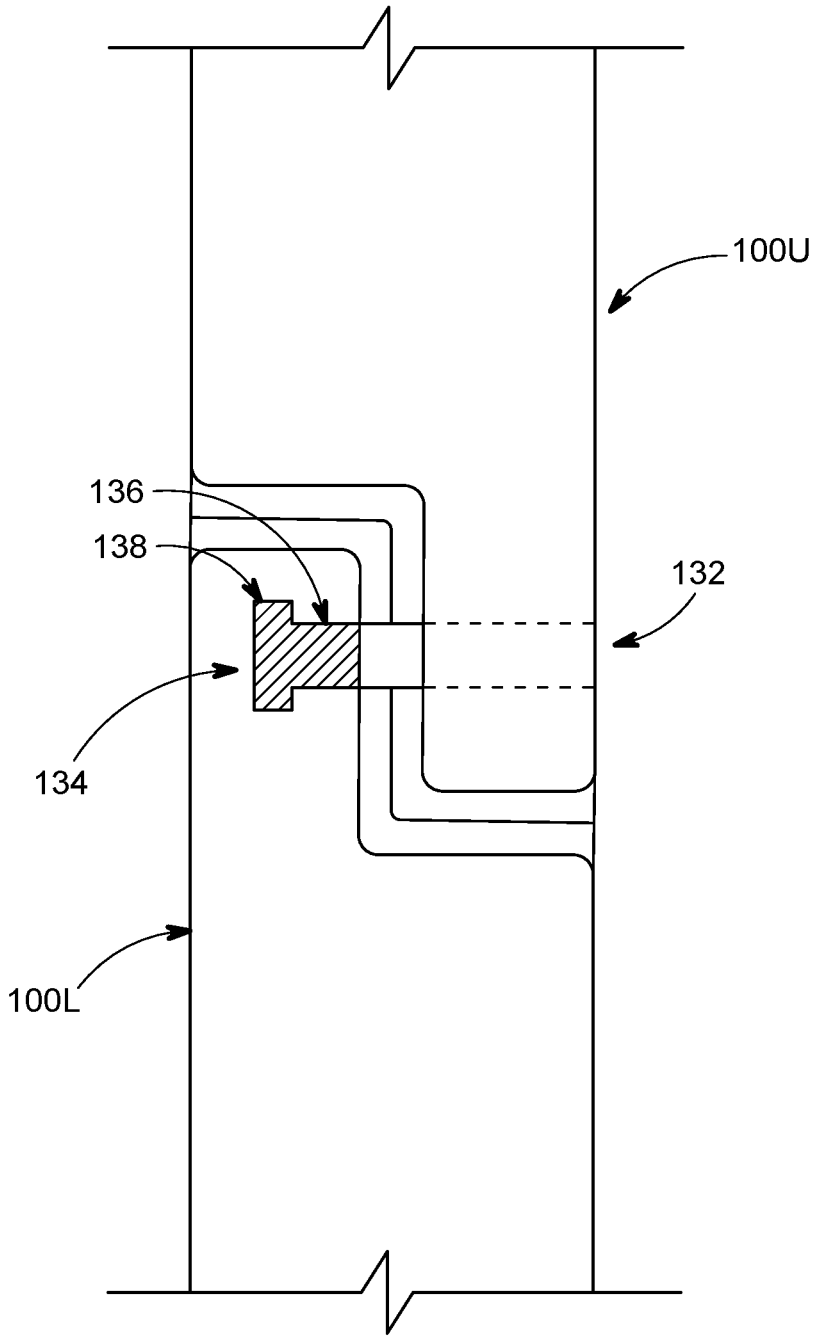
FIG. 5A, yet another hand-drawn sketch presents, on an enlarged scale, another partially fragmented detail from the window well modules shown in FIG. 4.

Please refer to FIGS. 5 and 5A for a detailed description of how adjacent window well modules 100L and 100U are secured together. Referring initially to FIG. 5, please note that the window well modules 100L and 100U are hollow. This is clearly an advantage over the prior art. Consider for example, the '300 patent to Hawkes, which discloses a prior art window well "weighing less than about 400 pounds," and which is typically installed by one, two or perhaps three workers "without requiring a crane or other lifting device." The design of my window well modules 100L and 100U clearly provide an advantage over such prior art window well modules, because of my hollow air space design. In addition, my double-walled structure for the window well modules 100L and 100U of the present subject matter possess structural strength to more than meet ordinary stresses that occur.

While current embodiments of the window well modules 100L and 100U of the present subject matter have wall sections that are about 0.25 inches thick, those of ordinary skill in the field of the present subject matter know that wall thicknesses can be modified to reduce stress arising from a variety of situations.

FIG. 5 illustrates how an underside surface of an upper window well module 100U is dimensioned and configured to mesh (as an interference fit) with the upper surface, consisting of the upper wall section 108L and the ledge 110L a lower window well module 100L. that is unitary with the outer wall section 106. In one embodiment (FIG. 5) a threaded fastener, e.g., a machine screw (not shown), can be can be arranged within a through bore 130 to removably secure the upper and lower window well modules 100U and 100L together. In another embodiment (FIG. 5A), one of the window well modules 100U and 100L, for example, the upper window well module 100U can include an aperture or opening 132, and the lower window well module 100L can include an internal, embedded receptacle 134 having an internally treaded barrel 136 integral with an annular base 138. The annular base 138 has a diameter greater than the diameter of the barrel 136. As a result, a fastener, e.g., a machine screw (not shown), can be screwed into the barrel 136 to secure the upper and lower window well modules 100U and 100L together.

Figure 3A:
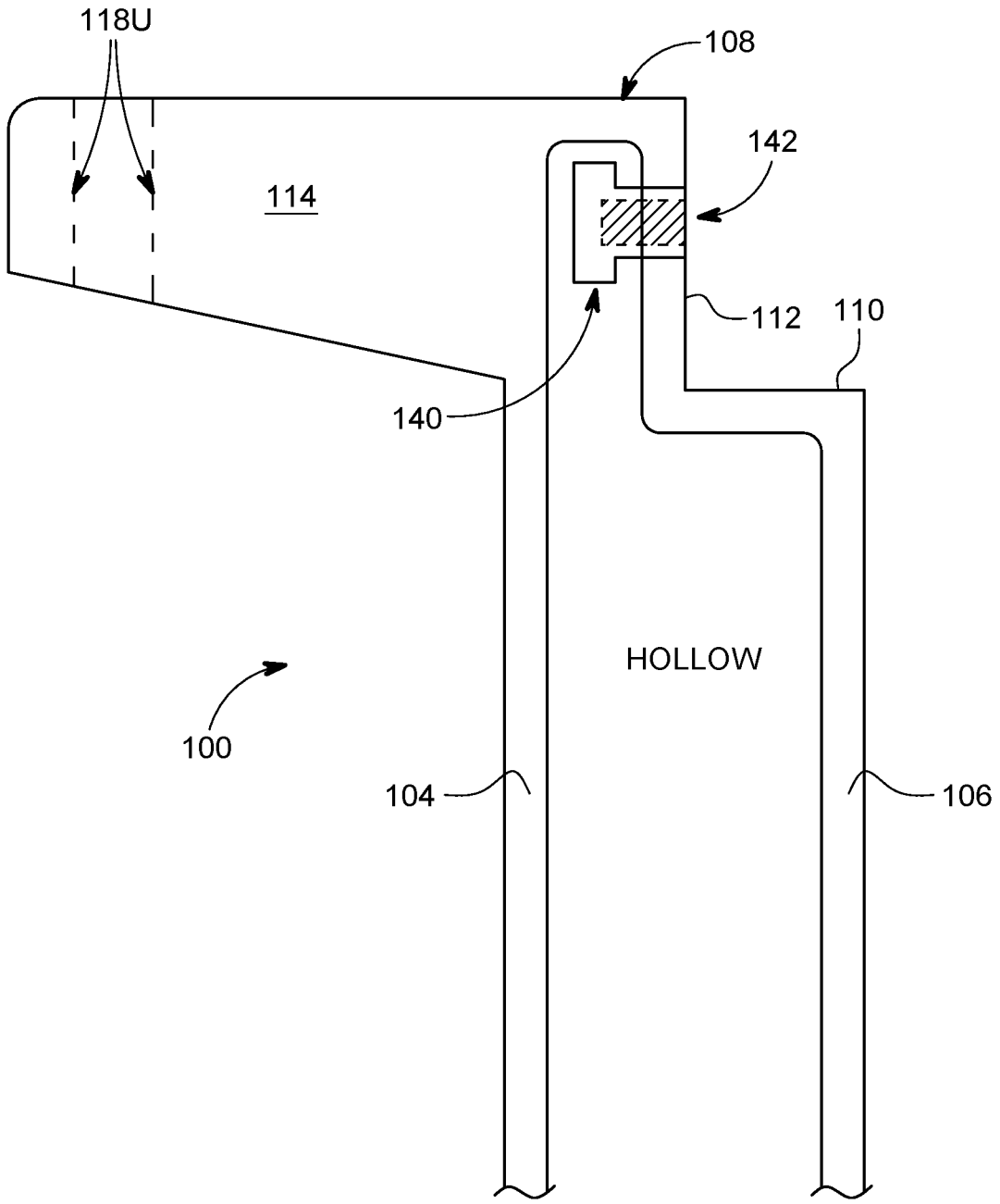
FIG. 3A is a sectional view of another embodiment from the plane 3-3.

In embodiments, the upper wall section 108 of the window well module 100 of the present subject matter can include a similar internal, embedded receptacle 140 adjacent the ledge 110 (please see FIG. 3A), for enabling a threaded fastener, e.g., a machine screw (not shown), to be arranged within an opening 142 through the vertically oriented exterior sidewall portion 112 that is unitary with ledge 110.

Figure 6:
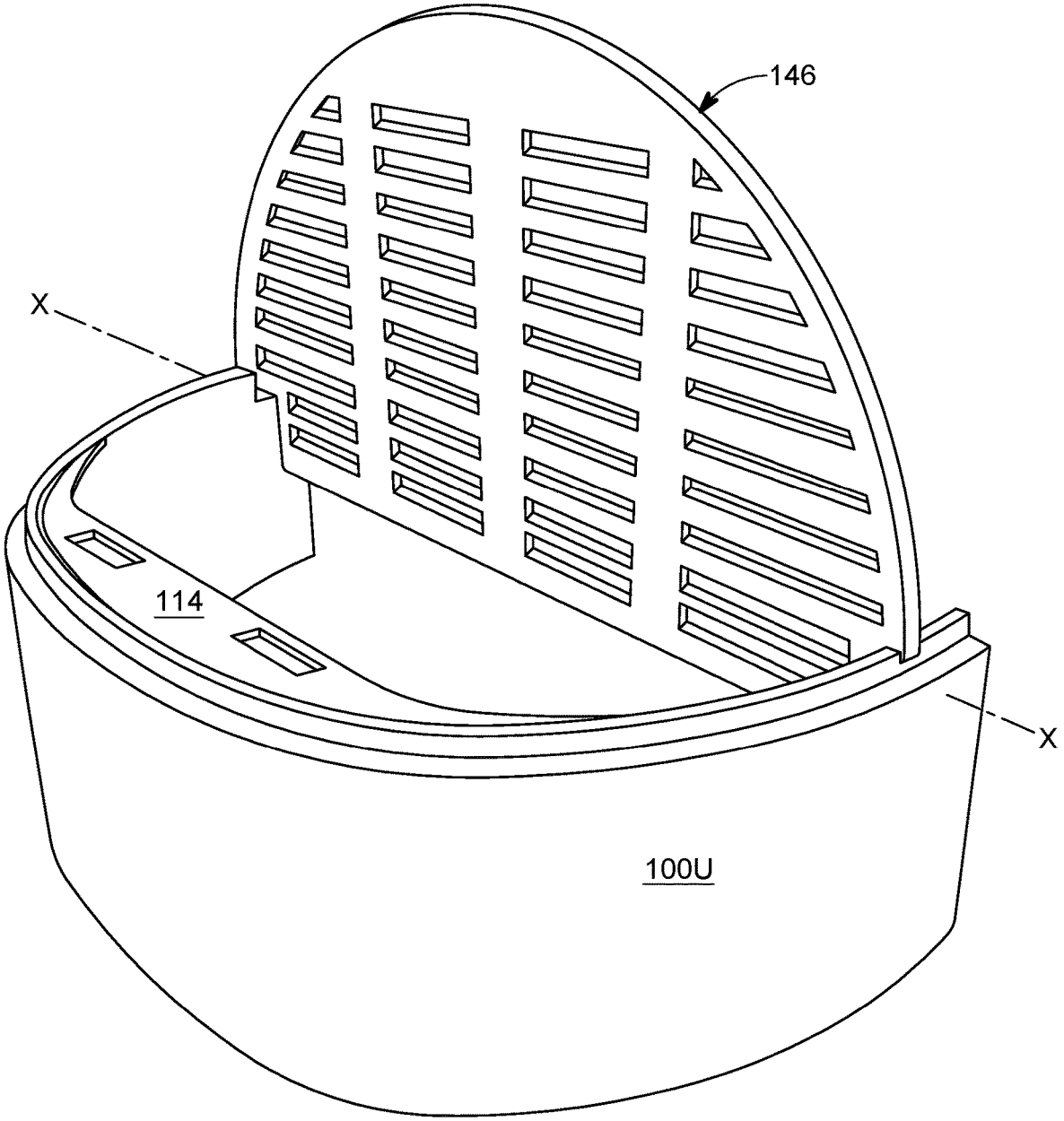
FIG. 6 presents a model, of the embodiment shown in FIG. 1, with a cover.

In still other embodiments, an upper window well unit or module 100U can include a cover—pivotable about an axis X-X spaced from the upper horizontally oriented lateral member 114—such as the louvered cover 146 shown in FIG. 6.

Figure 7:
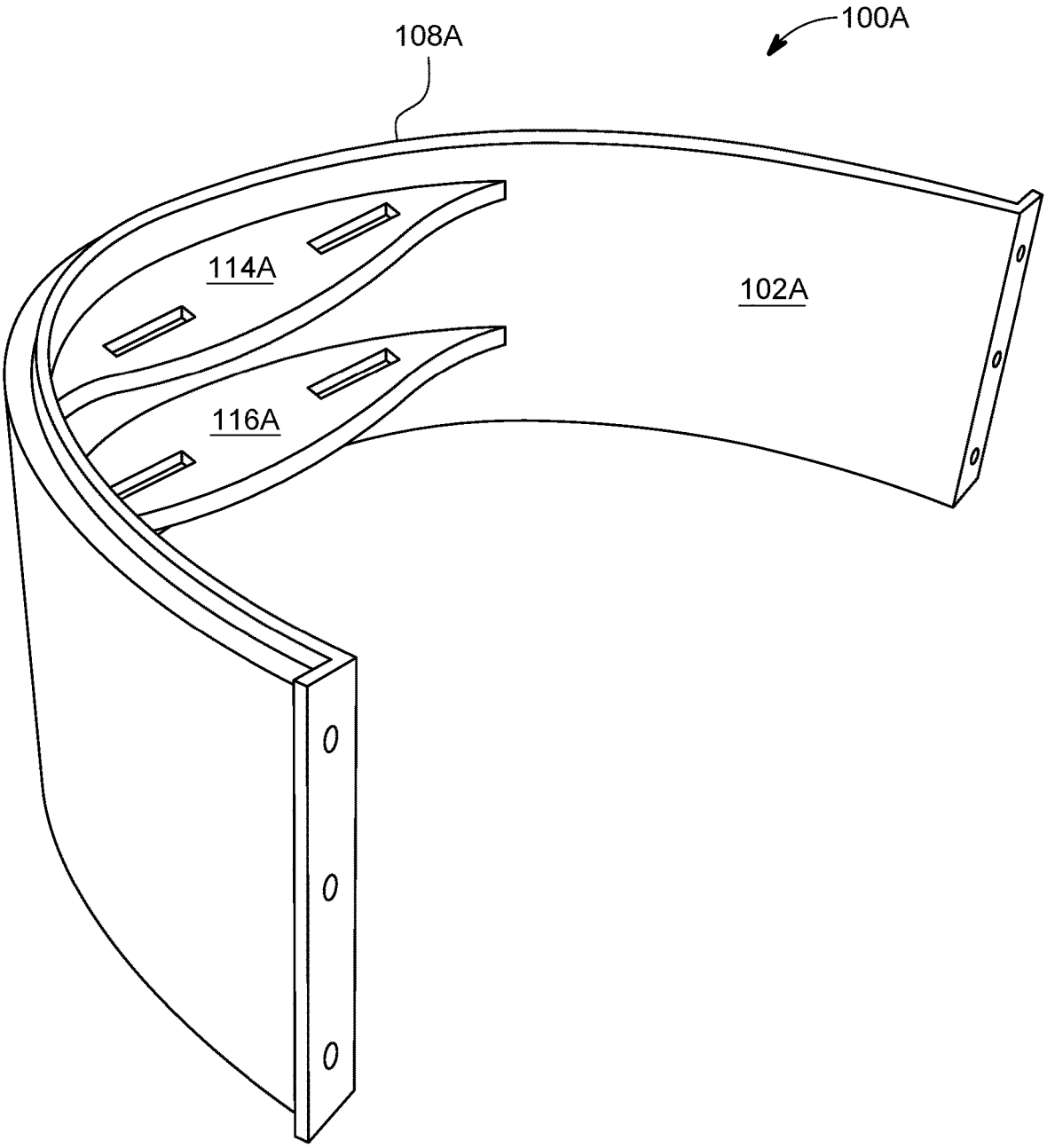
FIG. 7 depicts a model, presented in perspective, of another embodiment of a one-piece window well unit or module according to the present subject matter.

In yet other embodiments of the unitary window well module 100A of the present subject matter, it may be desirable that the upper horizontally oriented lateral member 114A be spaced between the upper wall section 108A and lateral member 116A, and be unitary with curved inner wall 102A, as shown in FIG. 7.

Unitary window well units or modules 100 of the present subject matter can be made via an assortment of commercial processes including but not limited to blow molding, injection molding, and rotational (also known as "roto") molding.

In addition, the unitary double-walled window well units or modules 100 of the present invention can, for example, be made of aluminum including cast aluminum, or polyolefin, a type of polymer having the general formula (CH2CHR)n. Polyolefins are derived from olefins (also known as alkenes, a type of monomer having a double bond used to produce a polymer). The more dominant polyolefins, in a commercial sense, include polyethylene and polypropylene. Polyolefins having "specialized" properties are polybutene, polyisobutylene, and polymethylpentene.

In embodiments, it may be desirable to make the window well of the present subject matter from a material selected from the group consisting of aluminum, a composite, graphene, polyurethane, polyethylene (e.g., high density polyethylene), polypropylene, polybutene, polyisobutene, polymethylpentene, and sintered metal.

It may be economically advantageous to produce window well modules 100 via a so-called three-dimensional printing method, also known as additive printing. Well known three-dimensional printing (aka additive printing) methods, used to make useful articles from alumina, zirconia, zircon (i.e., zirconium silicate), and silicon carbide are described in U.S. Pat. No. 5,387,380 to Cima et al. Other known 3D printing methods to make useful articles from Al/Mg particles coated with metal (copper, nickel, zinc, or tin) are described in U.S. Pat. No. 7,141,207 to Jandeska et al.

What has been illustrated and described is a novel window well module. While the stackable module of the present subject matter has been described with reference to exemplary embodiments, the present subject matter is not to be limited to these examples. On the contrary, many alternatives, changes, and/or modifications will become apparent to those of ordinary skill in the field of the present subject matter after this patent application is read. As a result, all such alternatives, changes, and/or modifications are to be considered as part of the present subject matter insofar as they fall within the scope of the appended claims.

I claim:

1. A window well comprising:

a curved wall defining:

an inner wall section, an upper wall section unitary with the inner wall section, an outer wall section unitary with the upper wall section, wherein the inner and the outer wall sections have an air gap spaced therebetween, a base unitary with one of the inner wall and the outer wall sections, wherein the upper wall section defines a first upper surface portion unitary with the inner wall section and a second upper surface portion unitary with the first upper surface portion and the outer wall section, wherein one of the first and second upper surface portions is spaced further from the base than the other one of the first and second upper surface portions, wherein the base defines an underside surface configured to engage with the first and the second upper surface portions of a second window well, wherein the curved wall further defines:

a first member unitary with and extending from the inner wall section and spaced from the base, wherein the first member defines an aperture sized and configured for enabling a user to extend a palm therethrough.

2. The window well of claim 1, further including a cover pivotable about an axis spaced from the first member.

3. The window well of claim 1, wherein the curved wall further defines a first end portion unitary with the inner and the outer wall sections and a second end portion spaced from the first end portion and unitary with the inner and the outer wall sections, wherein the first and the second end portions are each configured and oriented transverse to the inner wall section for mounting to a building structure.

4. The window well of claim 1, wherein the curved wall further defines at least one second member unitary with and extending from the inner wall section, wherein the at least one second member is located adjacent the upper wall section and defines at least one aperture sized and configured for enabling a user to extend a palm therethrough.

5. The window well of claim 4, wherein the first member and the at least one second member each define a second aperture sized for enabling a user to extend a palm therethrough.

6. A window well comprising:

a curved wall defining:

an inner wall section, an upper wall section unitary with the inner wall section, an outer wall section unitary with the upper wall section, wherein the inner and the outer wall sections have an air gap spaced therebetween, a base unitary with one of the inner wall and the outer wall sections, wherein the upper wall section defines a first upper surface portion unitary with the inner wall section and a second upper surface portion unitary with the first upper surface portion and the outer wall section, wherein one of the first and second upper surface portions is spaced further from the base than the other one of the first and second upper surface portions, wherein the base defines an underside surface including a first base portion and a second base portion unitary with the first base portion, wherein the first and second base portions are configured to complement and engage with the first and second upper surface portions of a second window well, wherein the curved wall further defines:

a first member unitary with and extending from the inner wall section and spaced from the base, wherein the first member defines an aperture sized and configured for enabling a user to extend a hand therethrough.

7. The window well of claim 6, further including a cover pivotable about an axis spaced from the first member.

8. The window well of claim 6, wherein the curved wall further defines a first end portion unitary with the inner and the outer wall sections and a second end portion spaced from the first end portion and unitary with the inner and the outer wall sections, wherein the first and the second end portions are each configured and oriented transverse to the inner wall section for mounting the window well to a building structure.

9. The window well of claim 6, wherein the inner and the outer wall sections are each about 0.25 inches thick.

10. The window well of claim 9, made of a material selected from the group consisting of aluminum, graphene, sintered metal, polyurethane, polyethylene, polypropylene, polybutene, polyisobutylene, polymethylpentene, and a composite.

11. The window well of claim 6, wherein the curved wall further defines at least one second member unitary with and extending from the inner wall section, wherein the other member is located adjacent the upper wall section and defines at least one aperture configured for enabling a user to extend an adult palm therethrough.

12. The window well of claim 11, wherein the first member and the at least one second member each define a second aperture sized for enabling a user to extend a palm therethrough.

13. The window well of claim 12, wherein the at least one second member is unitary with one of the first and second upper surface portions of the second window well.

* * * * *